US008506017B2

(12) United States Patent
Southern

(10) Patent No.: US 8,506,017 B2
(45) Date of Patent: Aug. 13, 2013

(54) LOADING ARM WITH WEAR RESISTANT END, MINING EQUIPMENT USING THE ARM, AND METHOD OF USE

(76) Inventor: Philip W. Southern, Shinnston, WV (US)

( * ) Notice: Subject to any disclaimer, the term of this patent is extended or adjusted under 35 U.S.C. 154(b) by 517 days.

(21) Appl. No.: 12/724,549

(22) Filed: Mar. 16, 2010

(65) Prior Publication Data

US 2010/0237682 A1 Sep. 23, 2010

Related U.S. Application Data

(60) Provisional application No. 61/202,600, filed on Mar. 17, 2009.

(51) Int. Cl.
*E21C 35/183* (2006.01)

(52) U.S. Cl.
USPC ..... 299/18; 299/104; 299/113; 198/512; 198/642

(58) Field of Classification Search
CPC ..... E21C 35/183
USPC ..... 299/18, 64, 68, 75, 76, 77, 41.1, 299/113; 241/300, 102.2; 175/425, 426, 175/434; 172/719, 772, 772.5, 745; 83/835, 83/838, 839, 848, 851–855; 30/388, 504; 37/448–454; 198/497, 512, 518
See application file for complete search history.

(56) References Cited

U.S. PATENT DOCUMENTS

| | | | | |
|---|---|---|---|---|
| 2,696,288 | A * | 12/1954 | Ball | 198/515 |
| 4,159,055 | A * | 6/1979 | Eberle | 198/512 |
| 4,315,375 | A * | 2/1982 | Shinn | 37/460 |
| 2007/0082217 | A1 * | 4/2007 | Miller | 428/627 |

* cited by examiner

*Primary Examiner* — Sunil Singh
*Assistant Examiner* — Carib Oquendo
(74) *Attorney, Agent, or Firm* — Clark & Brody

(57) ABSTRACT

A loading arm assembly for directing material removed by a mining machining having a cutting head and a conveyor assembly includes one or more wear resistant plate assemblies at a terminal end of the loading arm. The wear resistant plate assembly includes a wear resistant plate arranged on a surface of arms of the loading arm assembly designed for directing the material to the conveyor. The assembly also has wear resistant inserts along a bottom surface of at least the arm end to protect the bottom surface of the arm from wear as well as the attachment of the wear resistant plate to the arm end.

13 Claims, 4 Drawing Sheets

LOADING ARM WITH WEAR RESISTANT END, MINING EQUIPMENT USING THE ARM, AND METHOD OF USE

This application claims priority under 35 USC 119(e) based on application Ser. No. 61/202,600 filed on Mar. 17, 2009, and which is incorporated in its entirety be reference.

FIELD OF THE INVENTION

The present invention relates to a material loading assembly used in mining equipment, and particularly a loading arm assembly that has a specially configured wear resistant assembly that reduces wear on the material-contacting parts of the loading arm assembly, increases mining productivity, and increases the longevity of the assembly itself.

BACKGROUND ART

In the mining industry, mining equipment, particularly coal mining equipment, includes a cutting head, a conveyor, and coal loading arms for directing the coal removed by the cutting head to the conveyor. FIG. 1 shows one type of mining equipment 10 that employs a cutting head 1 and a conveyor assembly 3. These continuous mining machines are well known in the prior art and a more detailed description of all of the features thereof is not deemed necessary for understanding of the invention.

FIG. 2 shows a view of a part of the machine 10 of FIG. 1 that is relevant to the invention. In FIG. 2, a pan 5 is positioned beneath the cutting head 1 and a pair of coal loading arms 7 (hereinafter loading arm assembly). The loading arm assemblies are arranged horizontally and rotate to direct coal to the conveyor 9 in the center of the pan 5. The ends of the coal loading arm assemblies are subject to much abrasive wear. In this regard, it is known to put wear plates on the ends of the arms of the assemblies.

In operation, the bottom of the loading arm assemblies that face the pan wear and this wear increases the gap between the bottom surface of the loading arm assembly and a top surface of the pan. This increase in the gap reduces the amount of coal that is swept into the conveyor. In fact, wear on the loading arm assemblies can reduce the rate of coal conveying by as much as one ton per minute.

As such, a need exists to improve the operation of these types of machines with respect to the loading arm assembly operation. The present invention responds to this need by the use of a specially configured wear resistant end that reduces the wear on the bottom of the loading arm assembly as well as protecting the wear resistant configuration so that its lifetime is extended.

SUMMARY OF THE INVENTION

In satisfaction of the objects of the invention, a loading arm assembly intended for use with a mining machine for directing mined material to a conveyor comprises a center hub configured with an opening for attachment to a drive to rotate the loading arm assembly. The loading arm assembly includes a plurality of arms extending from the hub with each arm having a top surface, a bottom surface and an arm end. The arm end has at least one surface for directing the removed material to the conveyor, and a wear resistant plate assembly. The plate assembly includes a wear plate made of a wear resistant material and a plurality of spaced apart spot welds extending along a length of the arm. The spot welds securing the wear plate to a face of the arm end. Also included are a plurality of inserts made of a wear resistant material embedded into a bottom surface of the arm end. The inserts are positioned between the spaced apart spot welds to provide wear resistance to the bottom surface of the arm and protect the spot welds during operation. The inserts can be positioned at different locations on the arm other than between the spot welds to provide additional wear resistance to the arm surfaces.

The arm can has two surfaces for directing the removed material to the conveyor, with each surface having the wear resistant plate assembly. The plates of each of the wear resistant plate assemblies can have adjoining edges that are welded together.

The wear resistant material can be any high hardness material such as tungsten carbide or the like.

The invention also includes a mining machining having a cutting head, a conveyor assembly for removing the material mined by the cutting head, and the inventive loading arm assemblies.

Another aspect of the invention is a method of mining a material using a mining machining having a cutting head, a conveyor assembly for removing the material mined by the cutting head, and the inventive loading arm assembly. The loading arm assembly is used for directing the material removed by the cutting head of the mining machine to the conveyor.

DESCRIPTION OF THE PREFERRED EMBODIMENTS

The invention comprises, in one embodiment, a loading arm assembly for a mining machine that uses a cutting head and a conveyor assembly for mining material and removing the material from the mining site. The loading arm assemblies direct the material mined by the cutting head to a conveyor of the conveyor assembly.

The inventive loading arm assembly includes a wear resistant plate assembly that protects one or more surfaces of the loading arm assembly that contact the mined material and are subject to excessive wear. While one feature of the wear resistant assembly is to reduce the wear on the loading arm assembly during operation, the assembly also protects the way that the wear resistant features of the assembly are secured to the loading arm assembly. This provides the added benefit of lengthening the life span of the wear resistant plate assembly so that it remains in service for a longer period of time.

The presence of the wear resistant plate significantly increases the productivity of the mining machine. This is because the surfaces subject to the most wear, i.e., the surfaces directing the mined material to the conveyor and the bottom surfaces of the loading arms that face stationary surfaces of the mining machine are both protected. This means that an expansion of the gap between the loading arm assemblies and the pan of the mining machine is minimized. Normally, this gap is about a quarter of an inch and will increase over time. The gap increases as a result of wear on the loading arm assemblies and this reduces the mass of the assemblies for directing the mined material to the conveyor. By providing wear resistance not only on the faces of the arms of the assembly that direct the mined material to the conveyor but the bottom surface of the arm, the expansion of the gap is significantly slowed so that high productivity is maintained during the mining operation.

Figure 1:
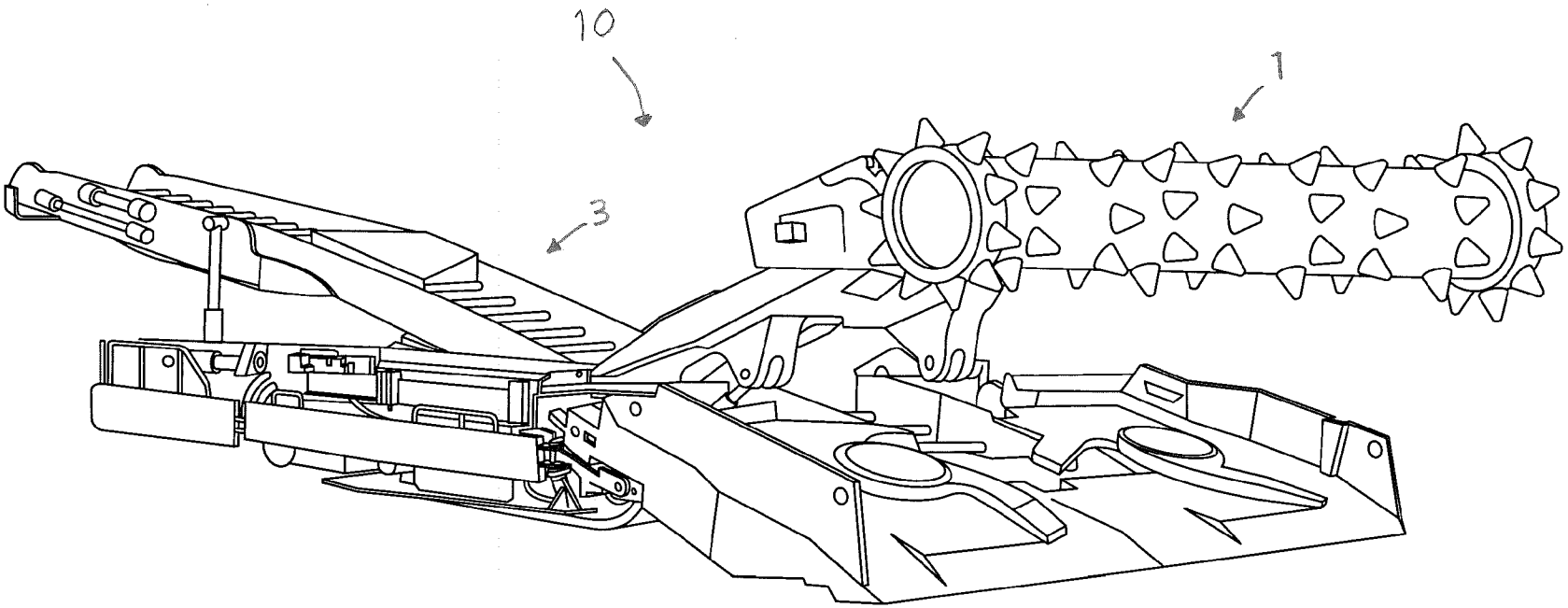
FIG. 1 is a perspective view of a prior art mining machine.
Figure 4:
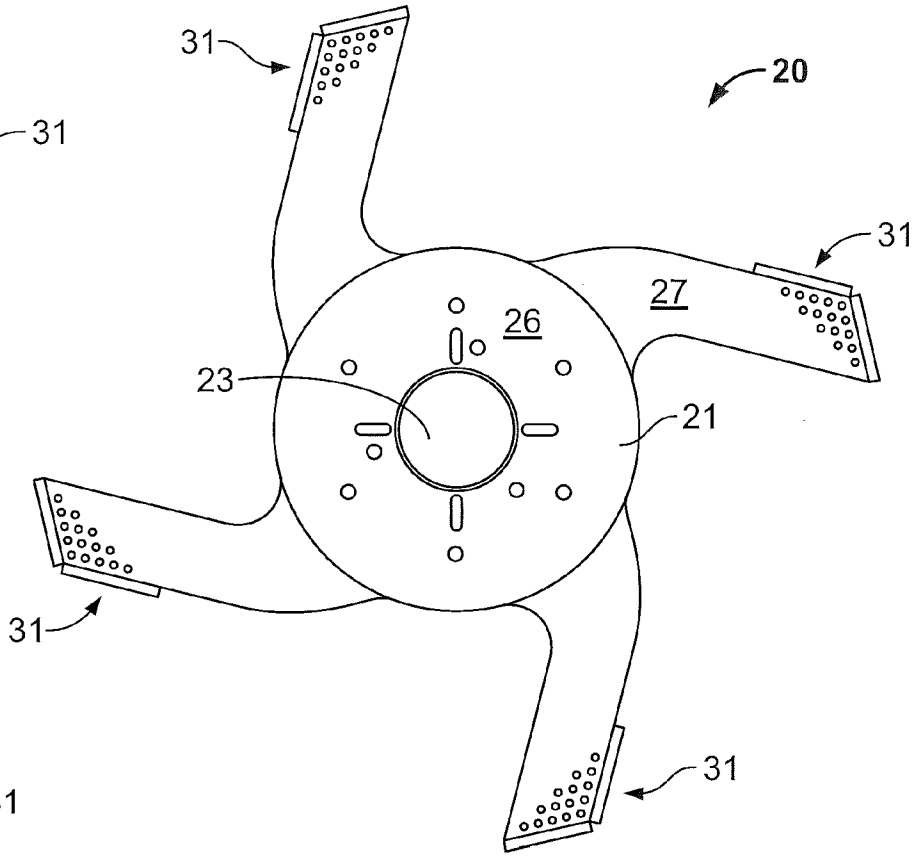
FIG. 4 is a bottom view of the wear side view of the loading arm of FIG. 4.
Figure 3:
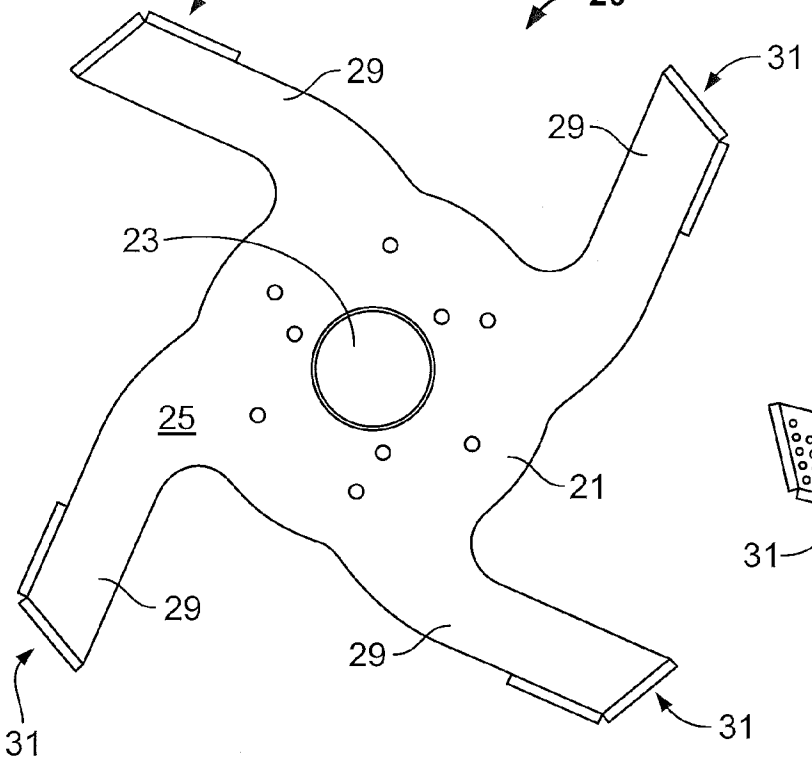
FIG. 3 is a top view of one embodiment of a loading arm of the invention.

One embodiment of the invention is shown in FIGS. 3-6. FIGS. 3 and 4 show top and bottom views of an exemplary loading arm assembly 20. While one assembly 20 is shown, it is typical for a pair to be used in a mining machine as shown in FIG. 1. The loading arm assembly 20 has a center hub 21, with an opening 23 therein. This center hub 21 is configured to link to a drive mechanism (not shown) that rotates the arm assembly in the desired direction. Since the hub configuration and drive mechanism are conventional and used in existing mining machines, a more detailed description is not necessary for understanding this aspect of the invention.

The loading arm assembly 20 has a hub top surface 25 and a hub bottom surface 26, and four arms 29, each arm 29 extending from the hub 21. Each arm 29 has a bottom surface 27 and a wear resistant plate assembly 31 on an end thereof.

Figure 6:
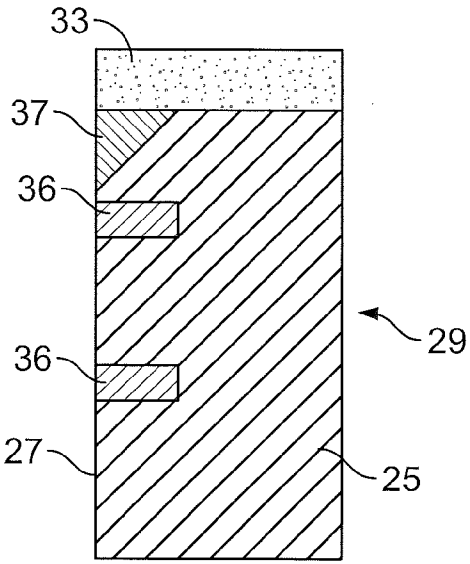
FIG. 6 is a cross section along the line A-A of FIG. 5.
Figure 5:
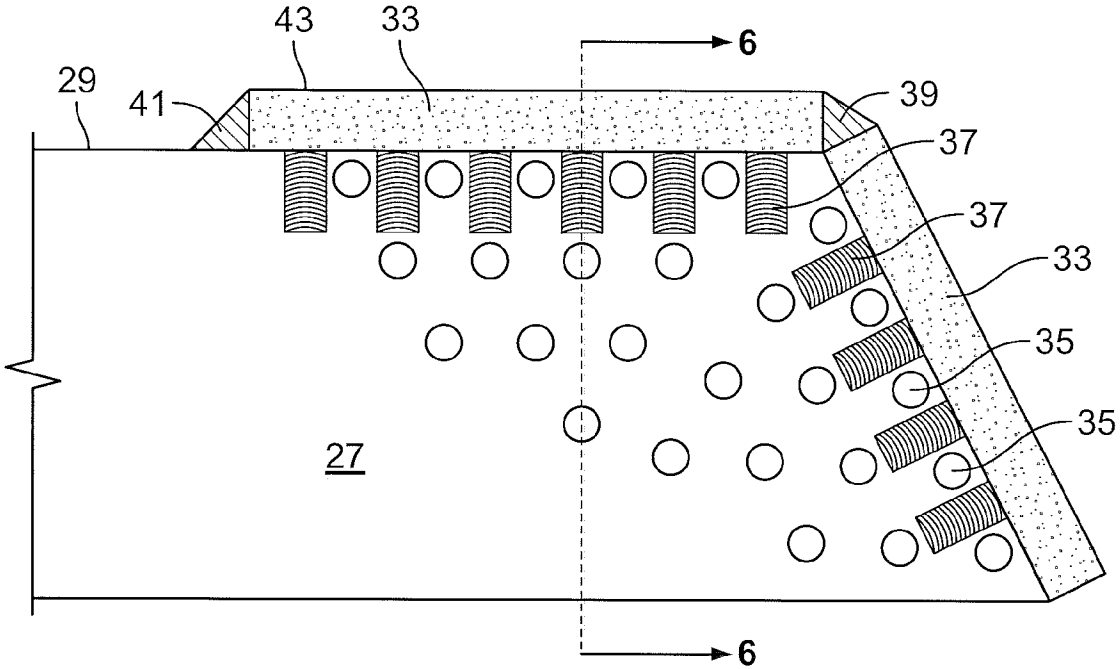
FIG. 5 shows the bottom side end of one of the arms showing a wear plate assembly.

Referring to FIGS. 5 and 6, (FIG. 6 is a sectional view along the line A-A of FIG. 5) in particular, each wear resistant plate assembly 31 has a plate 33 and a number of inserts 35. The plate 33 and inserts 35 can be made of any wear resistant material, with a preferred material being tungsten carbide. Each plate 33 is attached to the arm 29 using a number of spot welds 37. The spot welds 37 are spaced apart with the inserts 35 positioned between the welds. The inserts 35 can be embedded in the bottom surface of the arms 29 in any fashion, e.g., drilling holes and press fitting, drilling holes and using adhesives, a combination of these two techniques, or any other known ways.

The inserts 35, once in place, provide a wear surface 36. This wear surface 36 has a dual function of reducing the wear of the bottom surface 27 and protecting the spot welds 37 from being worn or washed away during rotation of the loading arm assembly during operation.

In the arm configuration of FIGS. 3-6, a pair of plates 33 are shown attached to two side surfaces of the arms 29, with each plate 33 having its own set of spot welds 37 and inserts 35 positioned between the spot welds. Here, the plates are also welded together at adjoining edges at 39. Another weld 41 is made to secure the edge 43 of the plate 33 to the arm 29. It should be understood that only one plate 33 could be used or more than two plates could be used depending on the configuration of the arm 29.

A number of inserts 35 are also shown positioned in the bottom surface 27 in locations other than between the spot welds 37. Besides protecting the welds 37 as described above, the wear surfaces 36 of the inserts 35 provide wear resistance for the bottom surface 27 in areas removed from the plates 33. The placement of the inserts 35 can be anywhere on the bottom surface 27, but it is preferred to concentrate them at the end of the arms 29 since this is the area of predominant wear.

The loading arm assembly is typically made from 3 inch steel plate, but can vary in thickness, material and design. While the loading arm assemblies can be used in mining of any type of material, a preferred material is coal mining and a preferred machine for use of the arms is the continuous type mining machines shown in FIG. 1.

Figure 2:
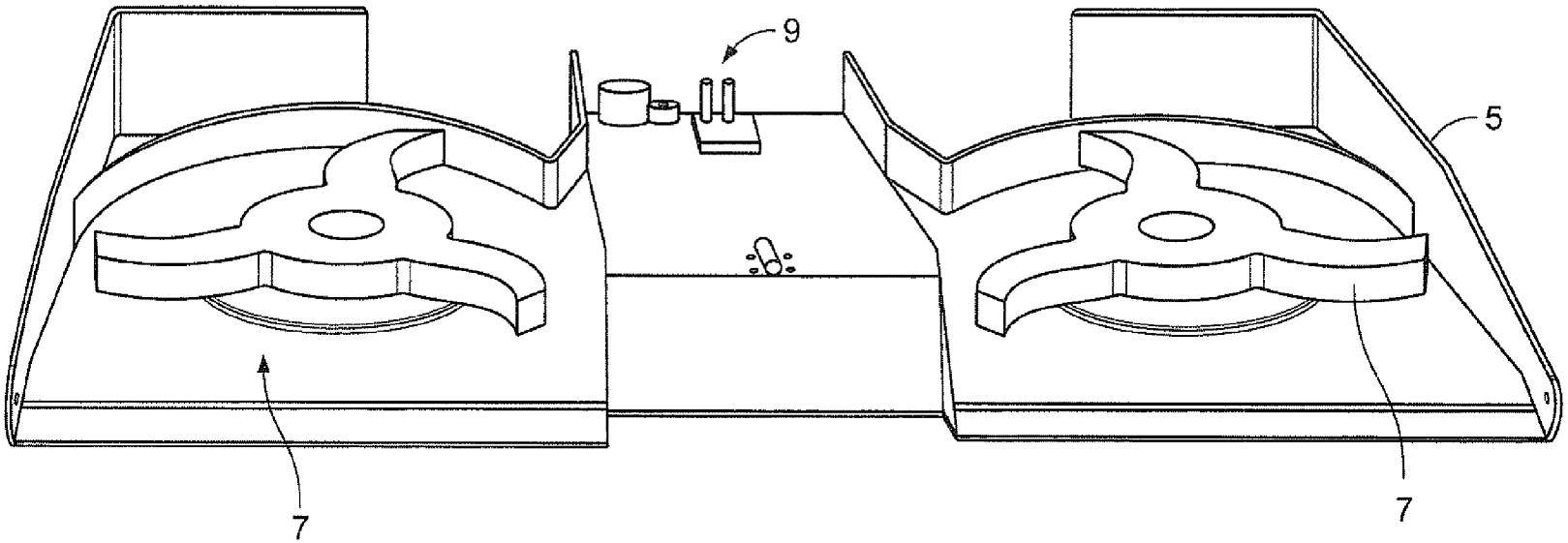
FIG. 2 (Prior Art)
FIG. 2 is a perspective view of a portion of the mining machine of FIG. 1.

In operation, the wear resistant plate assemblies are installed on an arm and the loading arm assembly is then installed in the mining machine. The loading arm assemblies rotate so that the plates 33 direct the mined material in the pan to the conveyor as seen in FIGS. 1 and 2. Because of the presence of the wear resistant plates and inserts, the wear on the bottom surface of the arms 29 is minimized and the gap between the loading arm assembly 20 and the pan does not expand as much as it would normally do. Minimizing the gap expansion means that the loading arm assemblies 20 can direct more mined material such as coal to the conveyor. The inserts 35 also protect the welds so that the plates 33 remain in place for a longer period of time and maintenance costs and reduced productivity due to maintenance is reduced.

As such, an invention has been disclosed in terms of preferred embodiments thereof which fulfills each and every one of the objects of the present invention as set forth above and provides a new and improved loading arm design for mining equipment and its method of use.

Of course, various changes, modifications and alterations from the teachings of the present invention may be contemplated by those skilled in the art without departing from the intended spirit and scope thereof. It is intended that the present invention only be limited by the terms of the appended claims.

I claim:

1. In a mining machine having a cutting head, a conveyor assembly for removing the material mined by the cutting head, and loading arm assembly for directing the removed material to a conveyor of the conveyor assembly, each loading arm assembly comprising a center hub configured with an opening for attachment to a drive to rotate the loading arm assembly, and a plurality of arms extending from the center hub, each arm having a top surface and a bottom surface and an arm end, the arm end having at least one surface for directing the removed material to the conveyor, the improvement comprising a wear resistant plate assembly that includes:

a wear plate made of a wear resistant material, a plurality of spaced apart spot welds extending along a length of the arm, the spot welds securing the wear plate to a face of the arm end;

a plurality of inserts made of a wear resistant material embedded into a bottom surface of the arm end, the inserts positioned between the spaced apart spot welds to provide wear resistance to the bottom surface of the arm and protect the spot welds during operation, the inserts also optionally positioned at other locations in the arm removed from the spot welds.

2. The mining machine of claim 1, wherein each arm has two surfaces for directing the removed material to the conveyor, with each surface having the wear resistant plate assembly.

3. The mining machine of claim 2, wherein the plates of each of the wear resistant plate assemblies having adjoining edges that are welded together.

4. The mining machine of claim 1, wherein one or both of the wear resistant material and plurality of inserts is tungsten carbide.

5. The mining machine of claim 1, wherein the inserts are positioned at the other locations in the arm removed from the spot welds.

6. The mining machine of claim 1, wherein a portion of the spot welds are exposed on the bottom surface of the arm.

7. A loading arm assembly for a mining machine comprising:

a center hub configured with an opening for attachment to a drive to rotate the loading arm assembly, and a plurality of arms extending from the center hub, each arm having a top surface and a bottom surface and an arm end, the arm end having at least one surface for directing the removed material to the conveyor, and a wear resistant plate assembly comprising:

a wear plate made of a wear resistant material, a plurality of spaced apart spot welds extending along a length of the arm, the spot welds securing the wear plate to a face of the arm end;

a plurality of inserts made of a wear resistant material embedded into a bottom surface of the arm end, the inserts positioned between the spaced apart spot welds to provide wear resistance to the bottom surface of the arm and protect the spot welds during operation.

8. The loading arm assembly of claim 7, wherein each arm has two surfaces for directing the removed material to the conveyor, with each surface having the wear resistant plate assembly.

9. The loading arm assembly of claim 8, wherein the plates of each of the wear resistant plate assemblies having adjoining edges that are welded together.

10. The loading arm assembly of claim 7, wherein one or both of the wear resistant material and plurality of inserts is tungsten carbide.

11. The loading arm assembly of claim 7, wherein the inserts are positioned at other locations in the arm removed from the spot welds.

12. The loading arm assembly of claim 7, wherein a portion of the spot welds are exposed on the bottom surface of the arm.

13. In a method of mining a material using a mining machine having a cutting head, a conveyor assembly for removing the material mined by the cutting head, and the loading arm assemblies of claim 7 for directing the removed material to a conveyor of the conveyor assembly, the loading arm assemblies comprising a center hub configured with an opening for attachment to a drive to rotate the loading arm, and a plurality of arms extending from the hub, each arm having a top surface and a bottom surface and an arm end, the arm end having at least one surface for directing the removed material to the conveyor and directing the material removed by the cutting head to the conveyor using the loading arms.

* * * * *